US009074774B2

(12) United States Patent
Cyris

(10) Patent No.: US 9,074,774 B2
(45) Date of Patent: Jul. 7, 2015

(54) HEATING APPARATUS PROVIDED WITH COMBUSTION CONTROL

(75) Inventor: Rudy Cyris, Couvin (BE)

(73) Assignee: KAJUFRAP, Luxembourg (LU)

( * ) Notice: Subject to any disclaimer, the term of this patent is extended or adjusted under 35 U.S.C. 154(b) by 387 days.

(21) Appl. No.: 13/519,743

(22) PCT Filed: Dec. 9, 2010

(86) PCT No.: PCT/EP2010/069279
§ 371 (c)(1),
(2), (4) Date: Sep. 19, 2012

(87) PCT Pub. No.: WO2011/082936
PCT Pub. Date: Jul. 14, 2011

(65) Prior Publication Data

US 2013/0000625 A1 Jan. 3, 2013

(30) Foreign Application Priority Data

Jan. 8, 2010 (EP) ..... 10150358

(51) Int. Cl.
*F24B 7/00* (2006.01)
*F24B 1/189* (2006.01)

(52) U.S. Cl.
CPC ..... *F24B 7/005* (2013.01); *F23N 2035/04* (2013.01); *F24B 1/1895* (2013.01)

(58) Field of Classification Search
CPC ..... F24B 7/005; F24B 1/1895
USPC ..... 126/67, 69; 431/2
See application file for complete search history.

(56) References Cited

U.S. PATENT DOCUMENTS

| | | | | |
|---|---|---|---|---|
| 4,162,808 | A * | 7/1979 | Kvapil et al. | 299/2 |
| 4,276,926 | A * | 7/1981 | Evangelow | 165/300 |
| 4,320,738 | A | 3/1982 | Johnson | |
| 4,397,293 | A * | 8/1983 | Pibernat | 126/69 |

(Continued)

FOREIGN PATENT DOCUMENTS

| | | | |
|---|---|---|---|
| AT | 393898 | B | 12/1991 |
| BE | 903620 | A1 | 3/1986 |
| DE | 10022877 | A1 | 9/2001 |
| EP | 1 563 228 | A1 | 6/2004 |

(Continued)

*Primary Examiner* — Avinash Savani
(74) *Attorney, Agent, or Firm* — Reinhart Boerner Van Deuren P.C.

(57) ABSTRACT

The invention relates to a solid-fuel heating apparatus that includes a combustion chamber (1) and a first flue-gas discharge duct (6), characterized in that the heating apparatus includes: a dual wall (2A) defining a second flue-gas discharge duct (2) located outside the combustion chamber and on the flue gas path between the combustion chamber (1) and said first duct (6), and provided in a vertical section thereof with a plurality of controlled communication valves (11, 12, 13, 14, etc.) arranged at respectively different heights (h1, h2, h3, h4, etc.), the second flue-gas discharge duct (2) being adapted via an opening (2B) in the lower portion of the dual wall (2A) so as to extend the flow path of the flue gas by an amount depending on the selection of the open inlet valve in the second duct (2) while the others are closed; adjusting means adapted for selecting, for each of the valves (11, 12, 13, 14, etc.), an open or closed position based on the temperature of the flue gas measured by a temperature probe (7) located at said first duct (6) so as to adjust the length of the flow path of the flue gas (3) in order to minimize the temperature of the flue gas while maintaining the latter above the dew point thereof.

10 Claims, 4 Drawing Sheets

(56) References Cited

U.S. PATENT DOCUMENTS

| | | | | |
|---|---|---|---|---|
| 4,506,653 | A * | 3/1985 | Bigelow et al. | 126/69 |
| 5,337,728 | A * | 8/1994 | Maruyama | 122/234 |

FOREIGN PATENT DOCUMENTS

| | | | |
|---|---|---|---|
| GB | 364280 | A | 1/1932 |
| GB | 767474 | A | 2/1957 |

* cited by examiner

HEATING APPARATUS PROVIDED WITH COMBUSTION CONTROL

SUBJECT-MATTER OF THE INVENTION

The present invention relates to a heating apparatus, more particularly a solid-fuel household heating apparatus, using wood or coal for example, provided with a control making it possible to optimize the combustion and to maximize the output of the apparatus.

Technological Background and Technical Problem to be Resolved

Traditionally, a heating apparatus using wood or coal can operate at several heating speeds. Typically, there is for example a maximum heating speed, corresponding to $P_{max}$ for instance, an intermediate or middle heating speed, corresponding to $P_{max}/2$, a minimum heating speed, corresponding to $P_{max}/4$, and an idle heating speed, corresponding to $P_{max}/8$. $P_{max}$ is the maximum power of the apparatus, which, for a wood stove, is typically between 5 and 15 kW. This classification is only provided as an example to make the following illustration of the invention possible and to provide orders of magnitude. Other intermediate heating speeds and other power criteria are of course possible. The so-called "idle" heating speed, for a wood stove, is typically intended for night-time use. Before going to bed, the user refills the stove with logs and adjusts the primary air valve to the minimum position. Upon waking up, the user refills the stove with logs and fully opens the valve to get the fire going again.

It is known that the output η of a heating apparatus, such as a household wood heating apparatus, is:

$$\eta = 100\% - \text{losses},$$

i.e.

$$\eta = 100\% - q_1 - q_2 - q_3,$$

where:

- $q_1$=loss related to the temperature of the flue gases (i.e. the heat that escapes through the chimney);
- $q_2$=loss related to the $CO/CO_2$ ratio (takes into account the quality of the combustion) and $NO_x$, $C_xH_y$ losses (these particles will be measured when the next European standard will come into force, theoretically in 2011); if the combustion is complete: $q_2=0$;
- $q_3$=loss in the ashes, constant and negligible (approximately 0.5%).

To optimize the output, it is therefore necessary to minimize $q_1$ and $q_2$, and more particularly $q_1$.

At the maximum heating speed, the losses $q_1$ are the highest and the output is therefore minimal, possibly lower than the nominal output of the apparatus, which is determined under very specific conditions.

Conversely, at the idle heating speed, the flue gas temperature is the lowest and the output is the highest, but care must be taken to stay above the dew point of the flue gases (60-70° C.), otherwise condensation occurs with soot accumulation.

The technical problem to be resolved, in order to optimize the output of the apparatus regardless of the chosen heating speed, preferably automatically, is to decrease the temperature of the flue gases or combustion gases in a controlled manner, especially at high heating speeds.

We also know heat recovery wood stoves such that the flue gases are evacuated from the heating body using a maximized flow path, through a suitable design of the discharge duct, possibly combined with a convector-type sheath (for example, see document BE 903 620 A).

AIMS OF THE INVENTION

The present invention aims to do away with the drawbacks of the state of the art.

More particularly, the invention aims to optimize combustion for each heating heating speed.

The invention also aims to ensure security intended to avoid any tarring in the flue linings, which might result in soot build-up and may lead to a chimney fire.

The invention also aims to optimize combustion regardless of the chimney height or type, as well as in the case of variable atmospheric conditions.

BRIEF DESCRIPTION OF THE INVENTION

A first aim of the present invention relates to a solid-fuel heating apparatus that includes a combustion chamber and a first flue-gas discharge duct, characterized in that the heating apparatus includes:

- a dual wall defining a second flue-gas discharge duct located outside the combustion chamber and on the flue gas path between the combustion chamber and said first duct, and provided in a vertical section thereof with a plurality of controlled communication valves arranged at respectively different heights (h1, h2, h3, h4, etc.), the second flue-gas discharge duct being adapted via an opening in the lower portion of the dual wall so as to extend the flow path of the flue gas by an amount depending on the selection of the open inlet valve in the second duct while the others are closed;
- adjusting means adapted for selecting, for each of the valves, an open or closed position based on the temperature of the flue gas measured by a temperature probe located at said first duct so as to adjust the length of the flow path of the flue gas in order to minimize the temperature of the flue gas while maintaining the latter above the dew point thereof.

According to example embodiments, the heating apparatus according to the invention also includes one or more of the following features:

- the first discharge duct is a vertical chimney or a horizontal or rear intake pipe;
- the temperature probe is situated at some distance from the end of the chimney emerging into the atmosphere;
- the temperature probe is located approximately 30 cm below the top of the chimney;
- the dual wall comprises, at each height h1, h2, h3, h4, etc., two valves situated close to the two side walls of the combustion chamber;
- the apparatus also includes a direct draft valve for the intake of flue gases into the first duct;
- the adjusting means include said temperature probe, a microcontroller, and an actuator in the form of a motor for opening and closing each valve;
- the control is an open- or closed-loop control, preferably of PID type;
- a primary or secondary air heating duct leading to the top of the combustion chamber is positioned between the combustion chamber and the second flue gas discharge duct.

A second aim of the invention relates to a method for controlling a heating apparatus as described above, characterized in that, in operation, said adjusting means are implemented so that:

at a maximum heating level of the apparatus, the highest valve h1 is open and the other valves are closed;

at an intermediate heating level of the apparatus, the highest valve h1 is closed and at least one lower-height valve h2, h3, h4, etc. is open, the other valves being closed;

at a minimum heating speed of the apparatus or when it is idling, all of the valves are closed except the smallest valve, or all of the valves are closed except the direct draft valve, directly allowing the flue gases to pass into the first duct.

DETAILED DESCRIPTION OF THE INVENTION

The principle implemented in the invention is to decrease the flue gas temperature precisely by extending the flow path of the flue gases between the combustion chamber and the intake into the chimney. Indeed, this extension of the flow path allows a greater expansion of the gases and/or a better exchange of heat with the walls, and therefore the cooling of the flue gases. According to the invention, it is desirable to constantly adapt the flow path of the flue gases to the different heating levels of the heating apparatus in order to optimize its output, regardless of the adopted heating speed.

Figure 1:
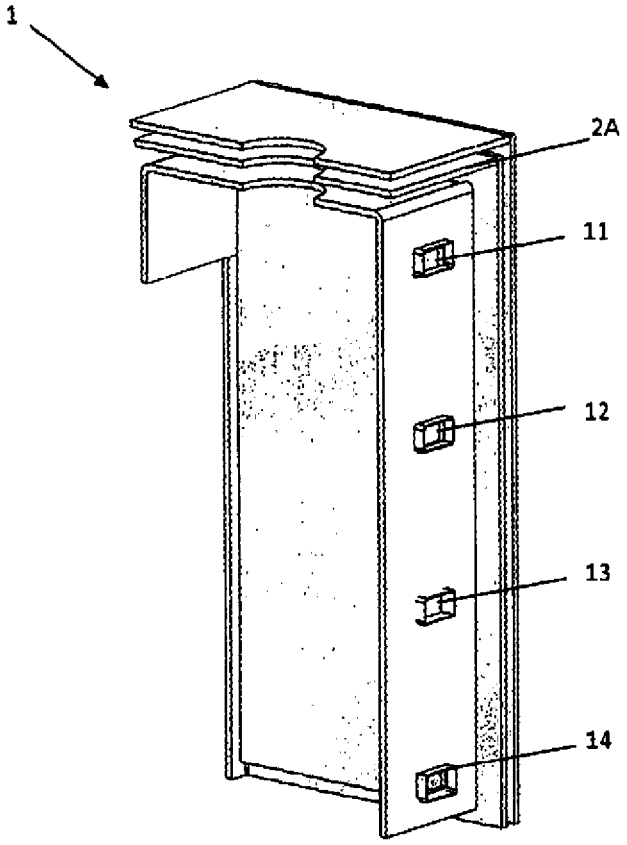
FIG. 1 shows a perspective cross-sectional view, from the back right, of one example of an embodiment of the controlled heating apparatus according to the present invention.
Figure 2:
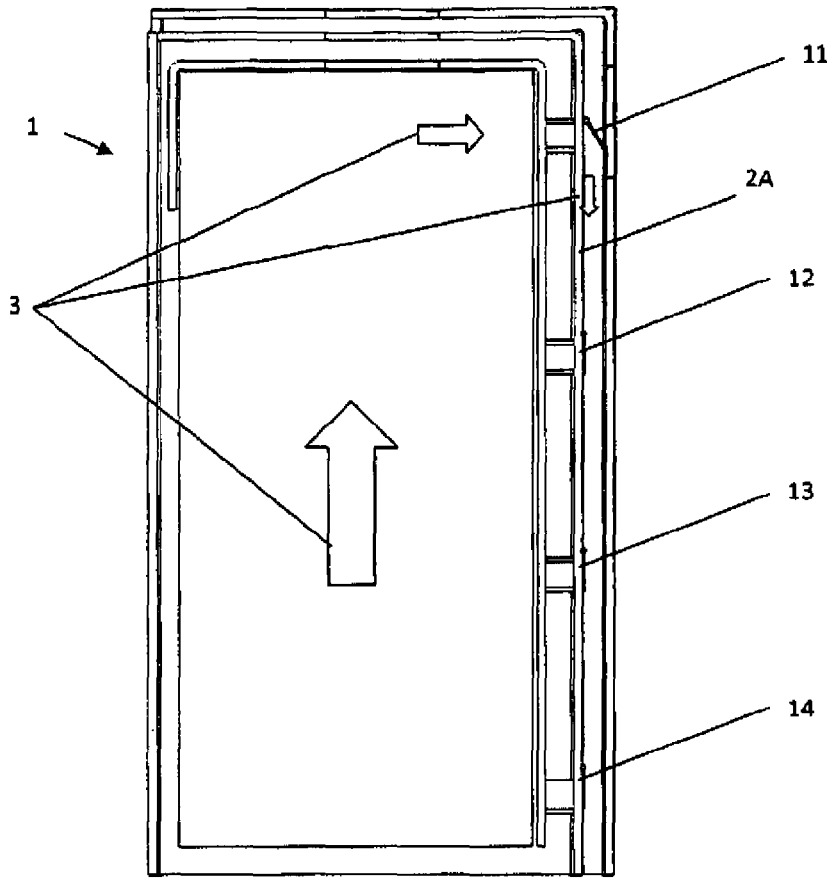
FIG. 2 shows a right cross-sectional view of the apparatus of FIG. 1.
Figure 3:
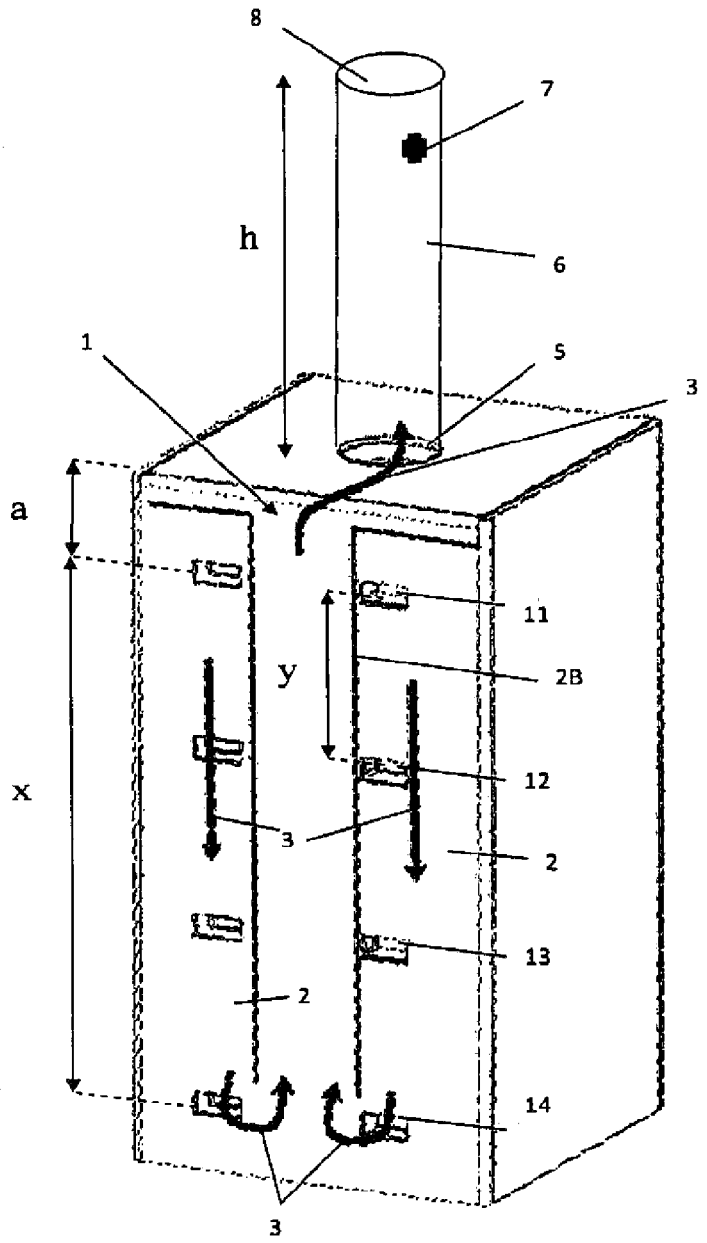
FIG. 3 diagrammatically illustrates a back perspective view of the apparatus of FIG. 1.

According to the invention, to that end, a heating apparatus is proposed as shown in FIGS. 1 and 2, in which the combustion chamber 1 is provided with a dual wall 2A that can communicate with the combustion chamber using a plurality of valves, for example at least four valves 11, 12, 13, 14 situated at different respective heights h1, h2, h3 and h4, such that h1>h2>h3>h4. For one skilled in the art, it is understood that any register or valve system suitable for controlling the draft of a heating apparatus can be used in the context of the present invention. The invention is advantageously implemented automatically using an open- or closed-loop control, including a temperature sensor (7) situated in the upper portion of the chimney (8, FIG. 3) and an actuator (not shown) that opens or closes the different aforementioned valves according to the measured value for the flue gas temperatures and the reference temperature. Each valve is secured to a small motor that is controlled by a wired connection or by radiofrequency.

The method according to the invention will then be applied by examining the different heating speeds separately.

Maximum Heating Speed

The temperature of the flue gases being the highest at this heating speed, as indicated above, the valve 11 situated at height h1 is opened in order to make the combustion gases 3 circulate over a significant distance, i.e. 2*x*+a+h (FIG. 3), to be able to cool them and thus obtain a better output. The valves 12, 13 and 14 remain closed (as in FIG. 2). It is, however, necessary to make sure not to cool the flue gases below the dew point (approximately 65° C.). It will be noted that, given that the height h of the chimneys is not constant, it is necessary to provide for the positioning of the flue gas temperature sensor at the top of chimney 6, for example 30 cm beyond the top 8. This positioning of the sensor makes it possible to make the invention compatible with any chimney height and to take variable atmospheric conditions into account.

Figure 4:
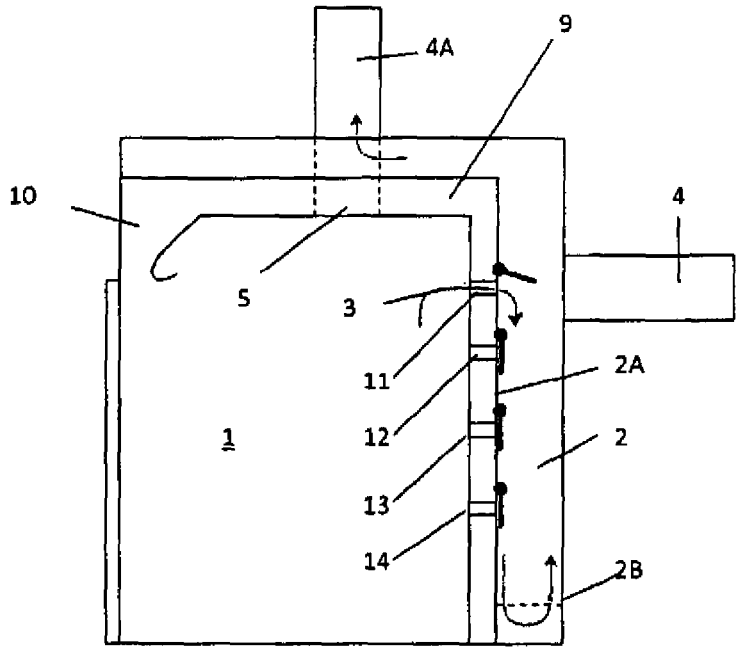
FIG. 4 diagrammatically shows a right cross-sectional view of the apparatus of FIG. 1, with the path of the flue gases shown at the maximum heating speed.

FIG. 4 shows the flow path of the flue gases in the case of the maximum heating speed (valve 11 open). The flue gases escape into the atmosphere through a rear 4 or top 4A passage (toward the chimney).

The "maze-like" flow path of the flue gases can be obtained using any means known by the man skilled in the art with a simple construction, for example using a sheet metal folded in an "L" shape leaving an opening 2B in the lower portion of the stove.

Middle Heating Speed

The temperature of the flue gases being lower than for the maximum heating speed, there will be a risk of condensation if the path intended to cool the flue gases remains the same as at the maximum heating speed. It is therefore necessary to shorten their path by controlling the opening and closing of the aforementioned valves. Concretely, when it goes from the maximum heating speed to the middle heating speed and the temperature of the flue gases measured at the top of the chimney gets closer to the dew point, an instruction is sent to close valve 11 and open valve 12 (valves 13 and 14 remaining closed), which will decrease the cooling distance by y (i.e. going from 2*x*+a+h to 2*x*+a+h−y, FIG. 3). The temperature of the flue gases will then increase to a value further from the dew point.

Minimum And Idle Heating Speed

At these heating speeds, the temperature of the flue gases risking again approaching (or dropping below) the dew point, valve 13 (14, etc.) will be open (valves 11, 12 closed) to still further decrease the distance traveled by the flue gases and to increase the flue gas temperature, and so on. If this is not sufficient, a direct draft valve 5 directly allowing the combustion gases to pass into the chimney, which is normally closed at the other heating speeds, will be open at the last end, to move away from the dew point.

In the case of high-output heating apparatuses with preheated air, for example of Woodbox® type (patent EP 1 563 228 B1), the "dual wall" of the apparatus according to the present invention becomes a triple wall, which exchanges heat with the heating channel of the incoming air, the latter also being heated by the combustion chamber. This "sandwiching" of the heating channel between two hot walls makes it possible in that case to increase the intake temperature of the preheated air in the combustion chamber and to decrease the losses $q_2$, since the combustion is improved when it is supplied with preheated air. However, the losses $q_1$ may also increase, which must be readjusted using the control according to the invention.

Still in the case of Woodbox®-type apparatuses provided with an upper cooking table, it has been noted that the upper heating double jacket constituted an insulating element that made cooking difficult. The apparatus according to the invention makes cooking possible again inasmuch as the cooking table can now be in contact with the hot air exhaust duct for the flue gases.

Simulations have shown that, for a temperature of approximately 80° C. at the chimney outlet and with air preheated to 300° C., or even 350° C., the output is, for a high-output wood log stove with combustion control according to the invention, of 85-90% and the $CO/CO_2$ ratio is of about 0.1%, which is in compliance with most of the standards or ecolabels in force in order to increase performance and reduce the pollution of the heating apparatuses (ex. "Green flame" label in France, Austria, etc.).

The invention claimed is:

1. A solid-fuel heating apparatus that includes a combustion chamber and a first flue-gas discharge duct, characterized in that the heating apparatus includes:

a dual wall defining a second flue-gas discharge duct located outside the combustion chamber and on the flue gas path between the combustion chamber, and said first duct, and provided in a vertical section thereof with a plurality of controlled communication valves located between the combustion chamber and second flue-gas discharge duct arranged at respectively different heights, the second flue-gas discharge duct being adapted via an opening in the lower portion of the dual wall so as to extend the flow path of the flue gas by an amount depending on the selection of the open inlet valve in the second duct while the others are closed;

adjusting means adapted for selecting, for each of the valves, an open or closed position based on the temperature of the flue gas measured by a temperature probe located at said first duct so as to adjust the length of the flow path of the flue gas in order to minimize the temperature of the flue gas while maintaining the latter above the dew point thereof.

2. The heating apparatus according to claim 1, characterized in that the first discharge duct is a vertical chimney or a horizontal or rear intake pipe.

3. The heating apparatus according to claim 2, characterized in that the temperature probe is situated at some distance from the end of the chimney emerging into the atmosphere.

4. The heating apparatus according to claim 3, characterized in that the temperature probe is located approximately 30 cm below the top of the chimney.

5. The heating apparatus according to claim 1, characterized in that the dual wall comprises, at each of the respectively different heights, two valves situated close to the two side walls of the combustion chamber.

6. The heating apparatus according to claim 1, characterized in that it also includes a direct draft valve for the intake of flue gases into the first duct.

7. The heating apparatus according to claim 1, characterized in that the adjusting means include said temperature probe, a microcontroller, and an actuator in the form of a motor for opening and closing each valve.

8. The heating apparatus according to claim 7, characterized in that the control is an open- or closed-loop control, preferably of PID type.

9. The heating apparatus according to claim 1, characterized in that a primary or secondary air heating duct leading to the top of the combustion chamber is positioned between the combustion chamber and the second flue gas discharge duct.

10. A method for controlling a heating apparatus according to claim 1, characterized in that, in operation, said adjusting means are implemented so that:

at a maximum heating level of the apparatus, a highest h1 valve is open and the other valves are closed;

at an intermediate heating level of the apparatus, the highest h1 valve is closed and at least one lower-height valve is open, the other valves being closed;

at a minimum heating speed of the apparatus or when it is idling, all of the valves are closed except the smallest valve, or all of the valves are closed except the direct draft valve, directly allowing the flue gases to pass into the first duct.

* * * * *